US006693234B2

(12) United States Patent
Smith

(10) Patent No.: US 6,693,234 B2
(45) **Date of Patent: *Feb. 17, 2004**

(54) INSTRUMENT STAND

(76) Inventor: Daniell Smith, 1730 Kearney St., #A-2, San Francisco, CA (US) 94133

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 10/032,927

(22) Filed: Dec. 27, 2001

(65) Prior Publication Data

US 2003/0121395 A1 Jul. 3, 2003

(51) Int. Cl.[7] ..... E10D 3/00
(52) U.S. Cl. ..... 84/327
(58) Field of Search ..... 248/176.1, 176.2, 248/177.1, 178.1, 166, 185, 169; 84/327, 329, 421

(56) References Cited

U.S. PATENT DOCUMENTS

| | | | | | |
|---|---|---|---|---|---|
| 4,205,818 | A | | 6/1980 | Lawler | 248/460 |
| D260,589 | S | | 9/1981 | O'Brien | D6/176 |
| D265,873 | S | | 8/1982 | Smith | D6/85 |
| 4,352,480 | A | | 10/1982 | Gathright | 248/443 |
| 4,561,339 | A | | 12/1985 | Jensen | 84/453 |
| 4,582,282 | A | | 4/1986 | Gracie | 248/167 |
| 4,592,265 | A | | 6/1986 | Steinberger | 84/327 |
| 4,742,751 | A | | 5/1988 | Cherry | 84/327 |
| 4,943,021 | A | | 7/1990 | Cien et al. | |
| 4,966,062 | A | | 10/1990 | Driggers et al. | 84/327 |
| 5,033,349 | A | | 7/1991 | Nechville | 84/327 |
| 5,116,005 | A | | 5/1992 | LaGroy | 248/168 |
| 5,149,901 | A | | 9/1992 | Boor et al. | 84/327 |
| 5,197,701 | A | | 3/1993 | Olson | 248/166 |
| D337,345 | S | | 7/1993 | Gracie | D17/99 |
| D342,401 | S | | 12/1993 | Kempton | D6/475 |
| 5,297,771 | A | * | 3/1994 | Gilbert | 248/443 |
| 5,313,866 | A | | 5/1994 | Smith | 84/327 |
| 5,315,910 | A | | 5/1994 | Soupios | 84/453 |
| 5,346,073 | A | | 9/1994 | Broersma et al. | 211/13 |
| 5,350,143 | A | | 9/1994 | Hoshino | 248/166 |
| 5,363,734 | A | | 11/1994 | Wilenken | 84/327 |
| 5,383,634 | A | | 1/1995 | Liao | 248/166 |
| 5,388,492 | A | | 2/1995 | Olson | 84/327 |
| D357,828 | S | | 5/1995 | Liao | D6/466 |
| 5,493,941 | A | | 2/1996 | Verge | 84/327 |
| 5,497,689 | A | | 3/1996 | Hoshino | 84/327 |
| D378,029 | S | | 2/1997 | Clark | D6/396 |
| D389,341 | S | | 1/1998 | Danner et al. | D6/466 |
| 5,713,547 | A | | 2/1998 | Yu | 248/166 |
| 5,744,735 | A | | 4/1998 | Liao | 84/327 |
| D396,579 | S | | 8/1998 | Kalayjian | D6/462 |
| 5,852,250 | A | * | 12/1998 | Cha | 84/327 |
| D407,240 | S | | 3/1999 | Payne | D6/450 |
| D411,698 | S | | 6/1999 | Kalayjian | D6/462 |
| 5,941,490 | A | | 8/1999 | Pearse | 248/302 |
| 5,957,417 | A | | 9/1999 | Yu | 248/166 |
| 6,005,176 | A | | 12/1999 | Yu | 84/327 |
| 6,015,121 | A | | 1/2000 | Reid | 248/150 |
| 6,036,159 | A | | 3/2000 | Yu | 284/443 |
| 6,054,645 | A | * | 4/2000 | Gauger | 84/411 R |
| 6,060,652 | A | * | 5/2000 | Lombardi | 84/421 |
| 6,113,040 | A | | 9/2000 | Yu | 248/166 |
| 6,127,612 | A | | 10/2000 | Yu | 84/327 |
| 6,145,801 | A | * | 11/2000 | Herring, Jr. | 211/85.6 |
| 6,189,158 | B1 | | 2/2001 | Lehoux | 2/455 |
| 6,209,829 | B1 | | 4/2001 | Yu | 248/122.1 |
| 6,252,150 | B1 | | 6/2001 | Johnson | 84/327 |

* cited by examiner

*Primary Examiner*—Kimberly Lockett
(74) *Attorney, Agent, or Firm*—Ray K. Shahani, Esq.

(57) ABSTRACT

An instrument stand for supporting a musical instrument, such as and particularly a guitar or electric bass, when in use or at rest, with an adjustable mounting portion to hold the instrument close to the instrument player's body and a flexible extending shaft that allows the instrument player to be mobile or move around while operating the instrument on the stand and use the flexible stand for adding intonation or musicality to the performance.

19 Claims, 7 Drawing Sheets

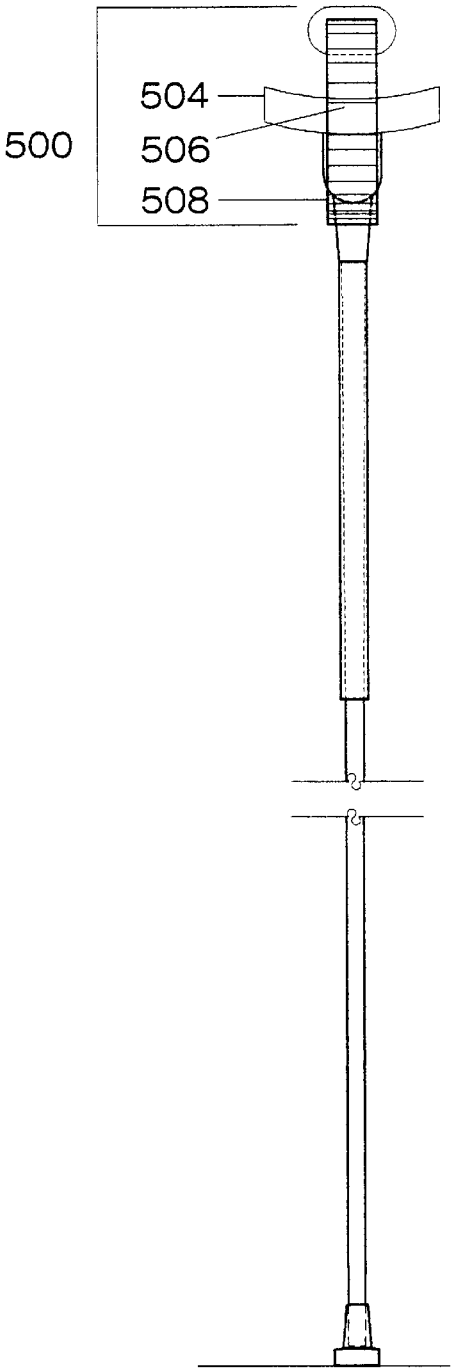
FIG.5A
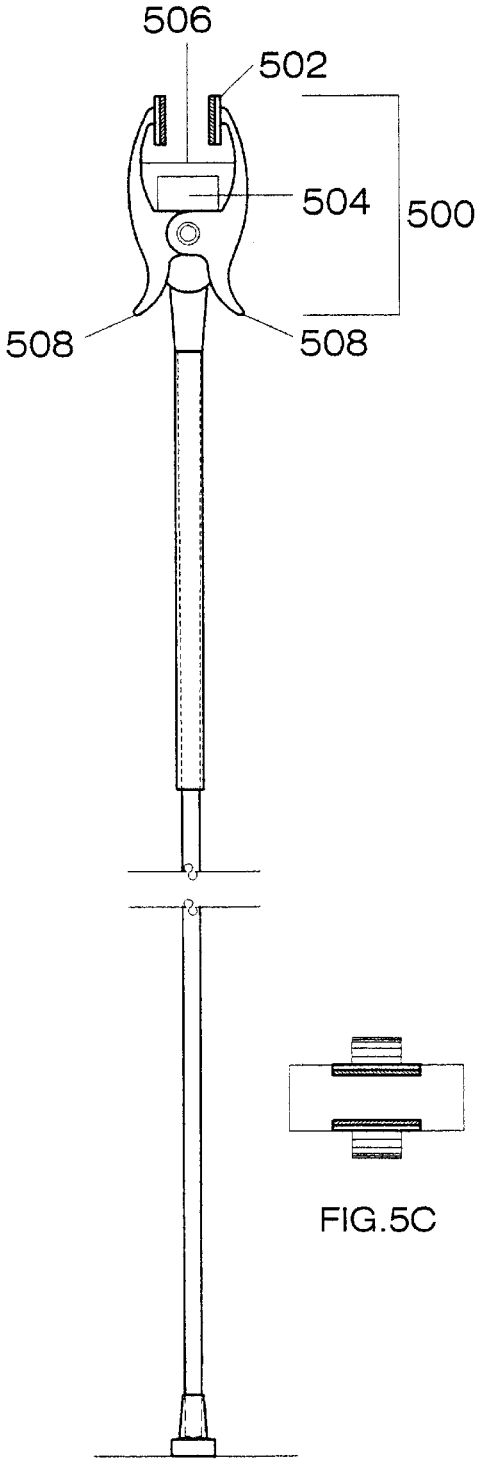
FIG.5B
FIG.5C

INSTRUMENT STAND

FIELD OF THE INVENTION

The present invention is related to devices that assist a player of a musical instrument, and in particular, to a stand for supporting a musical instrument such as a guitar or electric bass instrument, when in use or at rest, with an adjustable mounting portion to hold the instrument close to the instrument player's body with a flexible extending shaft that allows the player to move the instrument around while operating the instrument.

BACKGROUND OF THE INVENTION

Musical instruments are commonly rested on special stands when not in use. These stands hold and support the instrument in a stable position and prevent the musician to lay the instrument on the floor and to stoop over to pick it up. There are also devices available to support the weight of the instrument while the musician is playing it. Such devices are usually attached to the musician's neck or leg and limit his movement while playing the instrument.

There are different kinds of stands that support a musical instrument such as a guitar in a resting position. These devices range from conventional stands that are very bulky and hard to set up to others that are collapsible and easier to use. There have been numerous attempts to make a stand that is easily mountable, dismantled and compact. The most favorable forms of stands are strong, lightweight and easily installed or removed, and are adjustable for varying shapes of tuning heads of guitars or electric basses.

U.S. Pat. No. 6,209,829 issued on Apr. 3, 2001 to Yu et al teaches a stand that holds a guitar. This is one of the stands that has the advantage of being operated easily and folded into a compact composition.

U.S. Pat. No. 6,015,121 issued on Jan. 18, 2000 to Reid et al describes a collapsible stand that supports a guitar in an upright position. It is advantageous because it is easy to use, quick to erect, dismantle or fold away. This stand is light, easily portable, and compact.

These stands are rigid, and do not allow for use during performance with the instrument. Furthermore, they are not resilient or flexible, to provide resistance in playing and for ease of movement and to take the weight off the shoulder.

U.S. Pat. No. 4,742,751 to Cherry shows use of a device for holding the weight of an instrument while standing, which however, places or distributes the weight of the instrument across the shoulders and back, arms and neck, with potential for cumulative adverse, long-term effect. There are different types of neck straps and leg supports to accomplish this. The disadvantage of shoulder straps is that despite providing support for the weight of the instrument, they limit the capacity of the player to completely manipulate the instrument. Most of the leg straps on the other hand, are unappealing and require manual adjustments.

U.S. Pat. No. 5,493,941 issued on Feb. 27, 1996 to Verge describes a holder for a musical instrument which permits an instrument player to support the entire weight of the instrument through the holder while at the same time allowing maximum movement of the instrument. This device consists of a member that attaches to the back of the instrument and a second member that attaches to the belt of the instrument player and the two members are interlocked together. The disadvantage of this device is that the instrument player still has to support considerable weight of the instrument because it is attached to the player's belt. Therefore, there is a need for a freestanding support apparatus.

U.S. Pat. No. 6,189,158 issued on Feb. 20, 2001 to Lehoux et al describes a rest support for a guitar that is supported by a shoulder strap or waist belt allowing the guitar to hang down in the player's hip area. This distributes the weight of the guitar and prevents player fatigue.

U.S. Pat. No. 6,189,158 B1 issued on Feb. 20, 2001 to Lehoux describes an apparatus for supporting and positioning a guitar by a shoulder strap or waist belt that allows the guitar to hang down in the vicinity of the player's hip. This device still has the above mentioned disadvantage because it does not relieve the instrument player from the heavy and uncomfortable weight of a guitar when it loosely hangs at the strumming end of the instrument.

U.S. Pat. No. 4,592,265 issued on Jun. 3, 1986 to Steinberger teaches a foldable leg rest for a stringed musical instrument that rests on the leg of a seated musician and it can be easily opened and closed. This device is designed to maintain a substantially streamlined appearance of the body.

U.S. Pat. No. 4,966,062 issued on Oct. 30, 1990 to Driggers teaches a guitar support apparatus for use while the guitarist is in the sitting position. This apparatus consists of a leg support strap supporting three legs hinged together and a guitar support means opposite the strap. This apparatus sits on the guitar player's lap and supports the weight of the guitar. This device can not however be used when the musician is standing up.

U.S. Pat. No. 5,388,492 issued on Feb. 14, 1995 to Olson describes a similar guitar support that attaches with suction cups to the guitar from beneath and rests on the guitarist's leg during use. When not in use, it can be flattened against the side of the guitar making it possible to fit in the case.

U.S. Pat. No. 6,252,150 B1 issued on Jun. 26, 2001 to Johnson teaches yet another similar guitar fulcrum used for releasable attachment to a body of a guitar and holding the guitar above a guitar player's leg when the player is in a seated position. This fulcrum includes a leg pad with soft cushion material. This device can be maneuvered around and held in various upright positions prior to or when playing the guitar. This device has the same limitations of the above mentioned devices.

There are some stands that hold a guitar in playing position. U.S. Pat. No. 4,742,751 issued on May 10, 1988 to Cherry, referenced above, teaches such an apparatus that is used for holding a guitar in playing position. The limitations of this device is that it is very rigid and does not allow the guitar player to tilt the guitar around. It is a further disadvantage of this device that the guitar has to be mounted on the stand and also has to be attached to a neck strap. Furthermore, the device is freestanding, not simply an aid or stand for a musical instrument.

As such, it can be seen that currently available devices have many shortcomings and there is a need for a freestanding instrument support that can hold the instrument during use and also be flexible enough to give the instrument player freedom of movement for increasing intonation and musicality.

SUMMARY AND ADVANTAGES

In view of the foregoing limitations and shortcomings of the prior art, there exist a need for a stand that solves the above mentioned problems. It is therefore an object of the present invention to provide an improved device for holding a musical instrument, and, in particular a guitar which obviates for practical purposes, the above mentioned limitations.

An object and advantage of the present invention is to provide a mounting portion to accommodate varying shapes of instrument bodies, including various shaped guitar bodies. The mounting portion is in the form of an adjustable clip that accommodates different shapes and thicknesses of instruments. Another embodiment of the mounting portion is in the form of a clamp that also adjusts to different body shapes and thicknesses of the instrument.

Another object and advantage of the present invention is to provide support for a musical instrument while at rest that is also light in weight and very easy to use. The stand should be convenient to assemble and dismantle and transport.

A further object and advantage of the present invention is to provide support for a musical instrument while a musician is playing the instrument, for adding intonation and musicality. This stand allows the musician to conveniently hold and play the instrument at the same time. This relieves the musician from carrying the weight of the entire instrument.

Yet another object and advantage of the present invention is to provide mobility, resistance and resilience for the musician while playing the instrument. The extended shaft of the present invention is a flexible rod that allows the musician to deviate from the upright position and tilt the shaft to the sides. This helps the musician tremendously by increasing freedom of motion, increases resistance, and possibly varying flexibility.

In summary, the present invention is an improved instrument stand that overcomes the shortcomings of currently available musical stands.

Numerous other advantages and features of the present invention will become readily apparent from the following detailed description of the invention and the embodiments thereof, from the claims and from the accompanying drawings.

BRIEF DESCRIPTION OF THE DRAWINGS

The invention is illustrated below and represented schematically in the following drawings:

FIG. 5A is a representative schematic front view of yet another preferred embodiment of the guitar stand 100 of the present invention containing a spring clamp 500.

FIG. 5B is a representative schematic side view of the preferred embodiment of the guitar stand 100 of the present invention containing a spring clamp 500.

FIG. 5C is a representative schematic top view of a preferred embodiment of the spring clamp 500.

DETAILED DESCRIPTION OF THE PREFERRED EMBODIMENT

Figure 1:
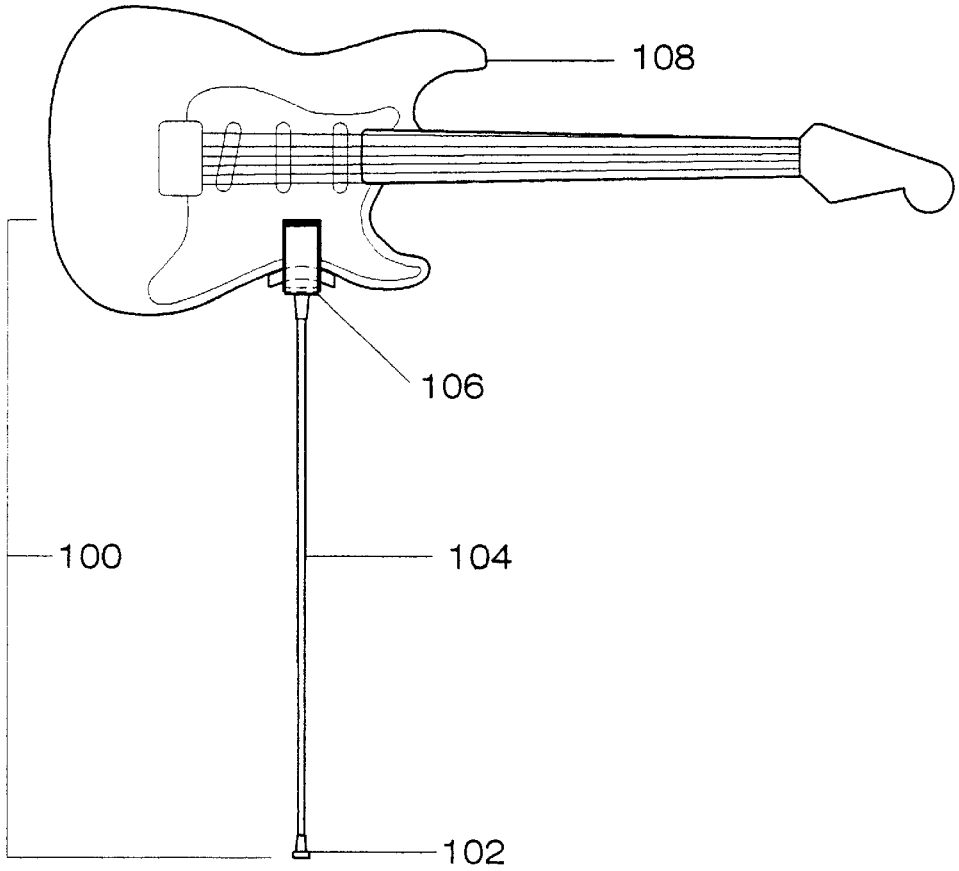
FIG. 1 is a representative schematic view of a preferred embodiment of the instrument stand 100 of the present invention holding a guitar in playing position.

The description that follows is presented to enable one skilled in the art to make and use the present invention, and is provided in the context of a particular application and its requirements. Various modifications to the disclosed embodiments will be apparent to those skilled in the art, and the general principals discussed below may be applied to other embodiments and applications without departing from the scope and spirit of the invention. Therefore, the invention is not intended to be limited to the embodiments disclosed, but the invention is to be given the largest possible scope which is consistent with the principals and features described herein.

It will be understood that in the event parts of different embodiments have similar functions or uses, they may have been given similar or identical reference numerals and descriptions. It will be understood that such duplication of reference numerals is intended solely for efficiency and ease of understanding the present invention, and are not to be construed as limiting in any way, or as implying that the various embodiments themselves are identical.

FIG. 1 is a representative schematic view of a preferred embodiment of the instrument stand 100 of the present invention holding a guitar in playing position. The instrument stand 100 has a rubber or other non-slip, high-friction material or structure foot 102, a flexible rod-like leg portion 104, and a coupling portion 106 that supports a guitar or other instrument 108 in a resting or playing position. The coupling portion 106 grips the guitar body and assists in the support of the weight of the guitar. The musician 99 can use this stand 100 to support the guitar or other instrument 108 at rest or when playing.

Figure 2:
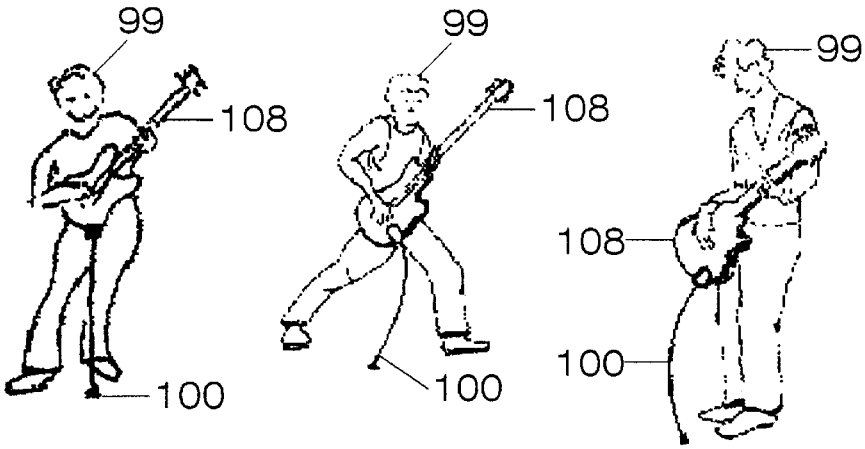
FIG. 2 is a representative schematic view of preferred embodiments of methods of use of the guitar stand 100 of the present invention while in use and with the guitar player 99 holding and playing the guitar in different positions.

FIG. 2 is a representative schematic view of preferred embodiments of methods of use of the guitar stand 100 of the present invention while in use and with the guitar player 99 holding and playing the guitar or other instrument 108 in different positions. It will be understood that the musician or other instrument player 99 can utilize the flexible, leg-like instrument stand 100 of the present invention to support the instrument 108 in a number of different ways, including straight up, or by flexing the rod-like leg portion 104 to any side or otherwise from above or from any axis or at any angle, including 90 degrees, with respect to the floor the player 99 is seated or standing on. Thus, it will be possible for the instrument stand 100 to provide support to the instrument in an essentially vertical orientation such as shown in FIG. 1. It will also be possible for the musician to maneuver the instrument so as to obtain support from the instrument stand 100 while the instruments stand 100 is in an angled position, or such that the elongated leg portion 104 of the instrument stand 100 is allowed to bend, bow, flex or develop a curvature. The strength of the material used for the instrument stand 100 and the leg portion 104 thereof will dictate the degree of curvature or bend which can be developed in the instrument stand without failure due to stress or deformation.

The preferred methods of use of the present invention include use of the instrument stand 100 as a type of leg or crutch to assist in the support of an instrument 108. The instrument stand need not be free-standing or self-supporting, but it does serve as an assistant to support of the instrument 108 while performing or playing. In particular, the instrument stand 100 of the present invention is particularly adapted for use with shoulder-held instruments, such as electric or acoustic guitars, including folk or classical guitars, electric bass guitars, shoulder-supported keyboards and synthesizers, percussion instruments, etc.

Figure 3A:
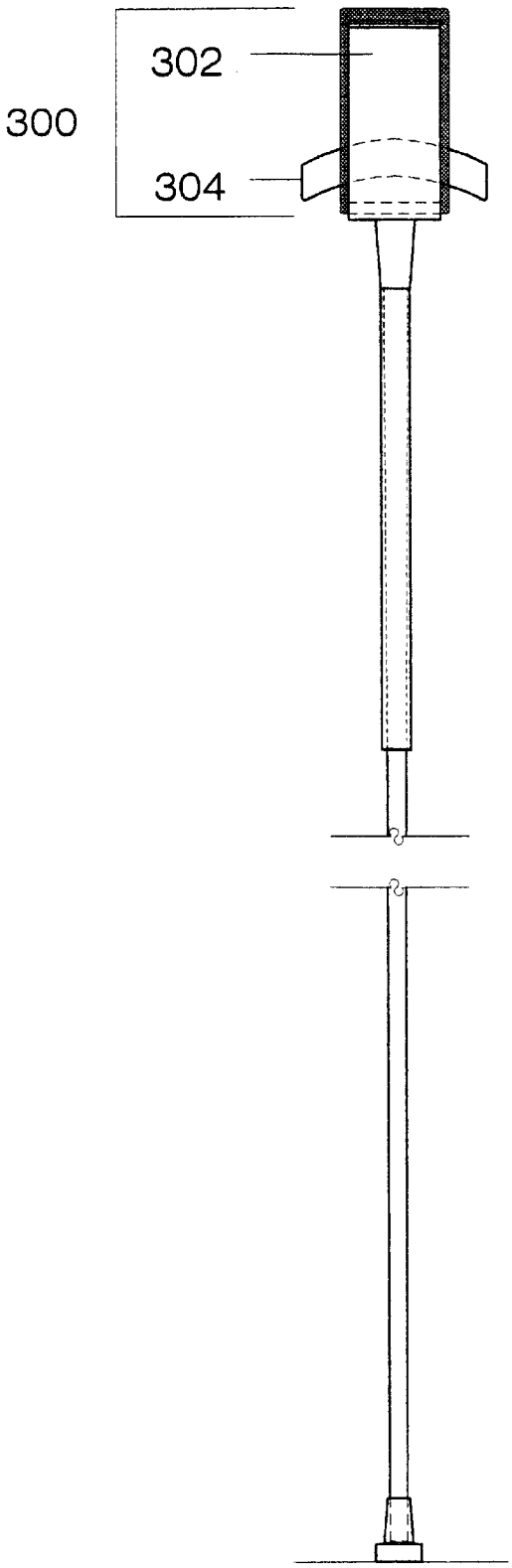
FIG. 3A is a representative schematic front view of a preferred embodiment of the guitar stand 100 of the present invention containing a mounting portion 300 made up of a clip portion 302.
Figure 3B:
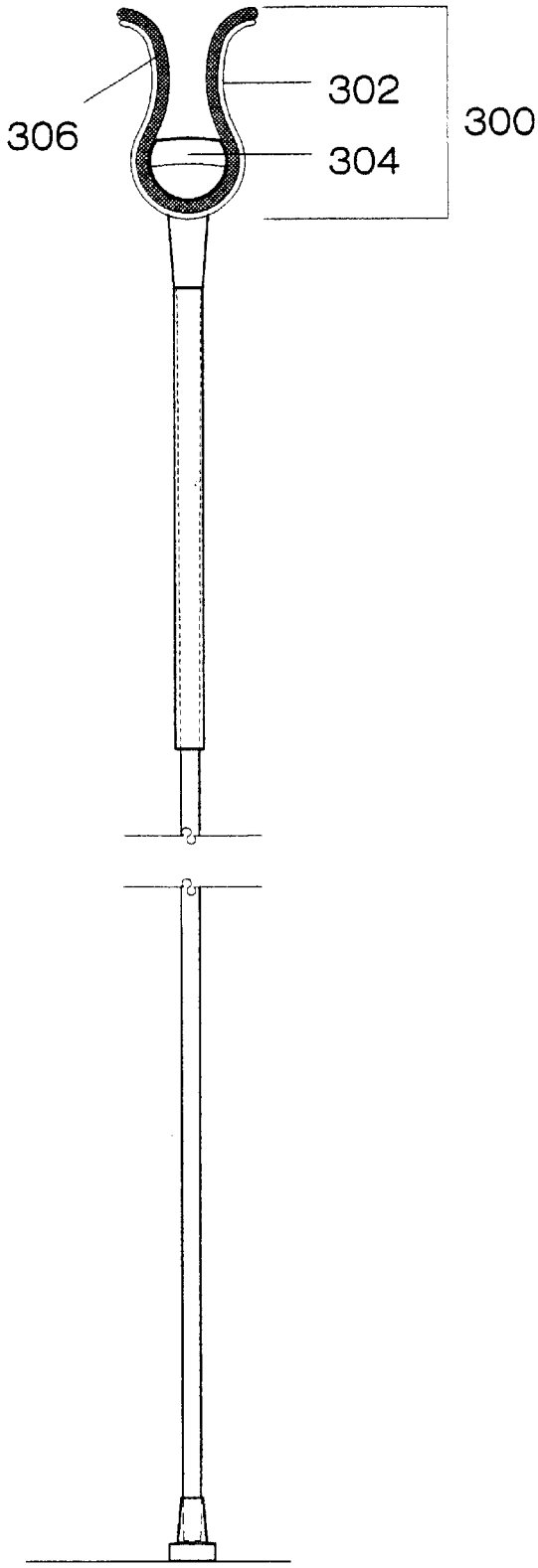
FIG. 3B is a representative schematic side view of a preferred embodiment of the guitar stand 100 of the present invention containing a mounting portion 300 made up of a clip portion 302.

FIG. 3A is a representative schematic front view of a preferred embodiment of the guitar stand 100 of the present invention containing a mounting portion 300 made up of a clip portion 302. FIG. 3B is a representative schematic side view of a preferred embodiment of the guitar stand 100 of the present invention containing a mounting portion 300 made up of a clip portion 302. The clip portion 302 can be spring steel or other flexible, resilient material appropriate for such use, optionally lined such as with lining 306 of neoprene or foam or other material. This lining 306 will serve to protect the finish of the instrument 108 as well as to grip or grasp or couple to the instrument 108.

Optional pad member 304 can be reversible, and shaped to accommodate concave or convex instrument body.

Figure 4A:
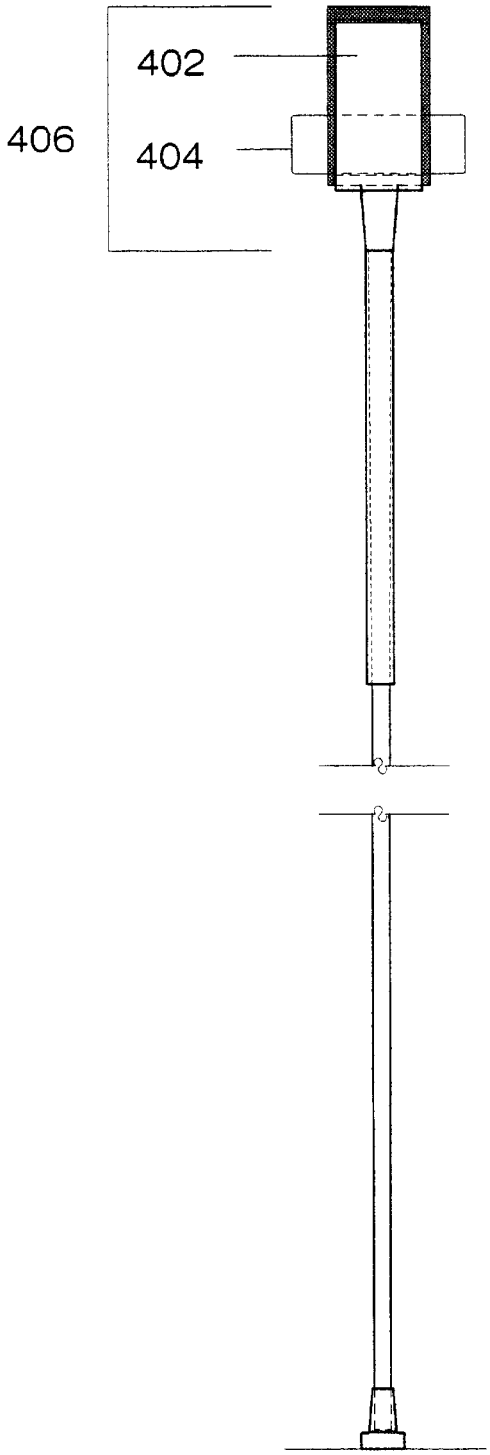
FIG. 4A is a representative schematic front view of a preferred embodiment of the guitar stand 100 of the present invention with an alternative mounting portion 400.

FIG. 4A is a representative schematic front view of a preferred embodiment of the guitar stand 100 of the present invention with an alternative mounting portion 400 made up of U-shaped metal or plastic material clip portion 402 having a straight or flat foam pad 404 for supporting the instrument, the foam pad 404 having a straight top, or curved as described above for matching the concavity or convexity of an instrument body placed thereupon.

Figure 4B:
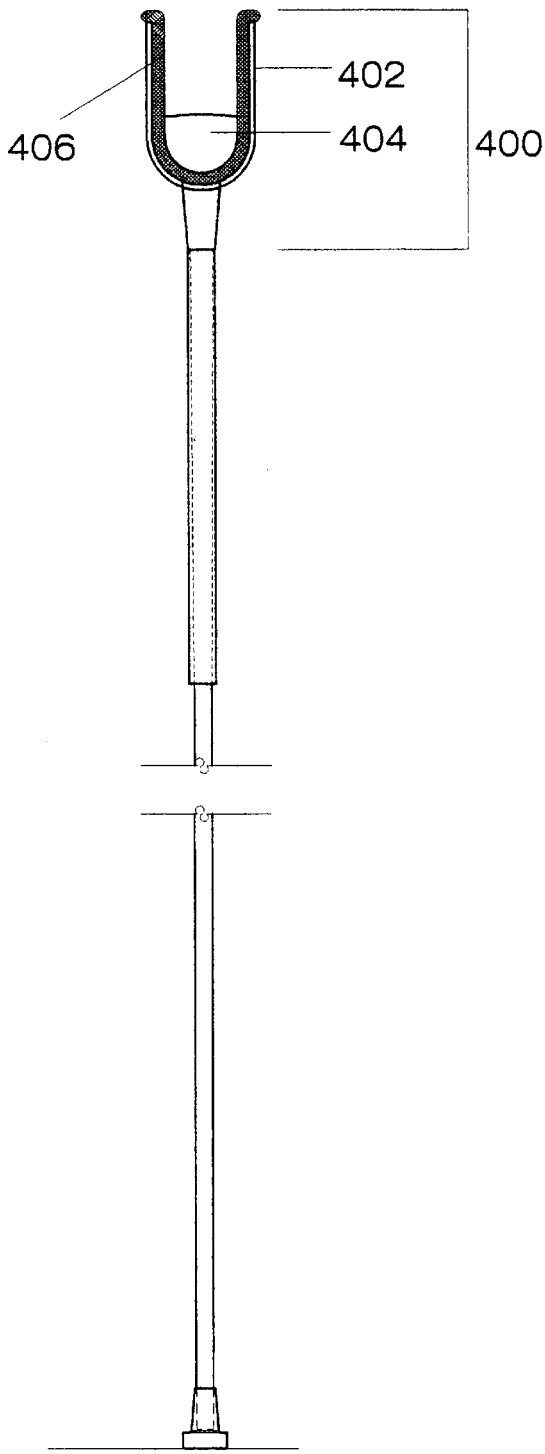
FIG. 4B is a representative schematic side view of a preferred embodiment of the guitar stand 100 of the present invention with an alternative mounting portion 400.

FIG. 4B is a representative schematic side view of a preferred embodiment of the guitar stand 100 of the present invention with an alternative mounting portion 400 made up of U-shaped metal or plastic material clip portion 402, optionally lined with compressible foam or other material lining 406.

FIG. 5A is a representative schematic front view of yet another preferred embodiment of the guitar stand 100 of the present invention containing a spring clamp 500 made up of plastic or metal. FIG. 5B is a representative schematic side view of the preferred embodiment of the guitar stand 100 of the present invention containing a spring clamp 500. The tip of the clamps are lined with neoprene or other foam padding material 502. This drawing also illustrates a foam pad portion 504 at the bottom of the clamp. It will be understood that the jaws 506 of the clamp portion 500 may be manually actuated by operation of lever portions 508.

FIG. 5C is a representative schematic top view of a preferred embodiment of the spring clamp 500. In a preferred embodiment, the jaws 506 of the clamp portion 500 will be spring-biased or spring-actuated to a closed or tightened position so as to firmly couple on to, grasp or grip the body of the instrument placed into the instrument stand 100 of the present invention.

Thus, it will be understood that central differences between FIGS. 3 and 4–5 is that FIGS. 3 are formed using spring steel and are flexible, while FIGS. 4 and 5 are essentially rigid clamps. Likewise, pad elements 304, 404 and 504 are interchangeable between the embodiments shown in FIGS. 3, 4 and 5.

Figure 6:
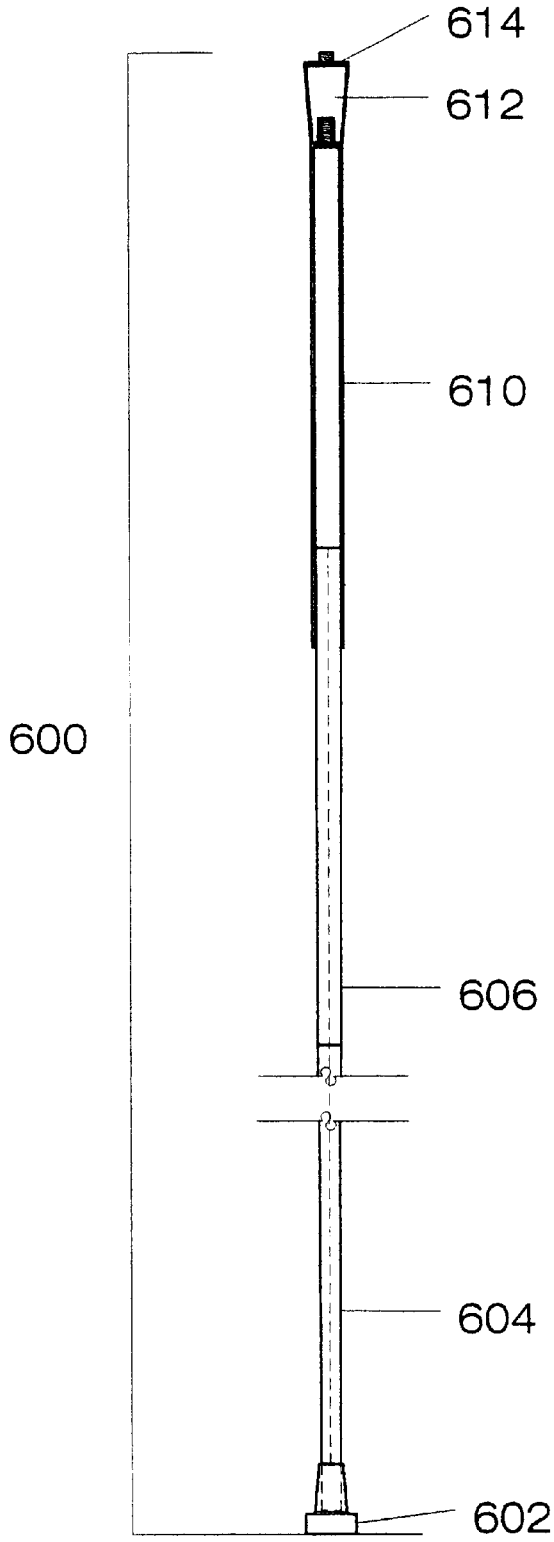
FIG. 6 is a representative schematic view of a preferred embodiment of the rod portion 600 and its components of the guitar stand 100 of the present invention.

FIG. 6 is a representative schematic detail view of a preferred embodiment of the rod portion 600 and its components of the guitar stand 100 of the present invention. The distal end 604 of the flexible rod-like leg portion 600 is placed into a rubber foot 602. The foot portion 602 maintains the rod-like leg portion 600 in place and from sliding, slipping, skipping or skidding during use. The rod portion 600 can have different sections, such as starting with a tapered or reducing diameter fiber composite or other type of material flexible shaft portion 604.

In a preferred embodiment, the present invention includes an optional tensioner rod 606 with thumb screw such as at the distal end or the proximal end of the leg portion 600 or elsewhere on the instrument stand 100. Additional sections 604, either tapered or straight, can be joined such as at junctions 608 and can be added on to the system to develop any desired length. The internal tensioner rod 606 can be formed through the entire leg portion 600 or it can extend only through certain portions thereof. In preferred embodiments, the internal tensioner rod 606 can adjust the leg portion 600 through a range of stiffnesses or flexibilities, from completely rigid to slightly resilient to very flexible and bow-like.

In a preferred embodiment, the top or proximal portion of the rod is a rigid shaft portion 610 that locks into the flexible shaft portion 604 at a distal end and into the collar 612 at the proximal end. An optional rubber gasket or washer 614 can also be placed at the collar 612 to couple securely to the coupling portion 106. It will be understood that any combination of flexible and rigid shaft portion combinations can be utilized in the present invention, with or without an internal tensioner rod 606.

It will be understood that different lengths of overall leg portion 600 can be used to provide instrument stands 100 of the present invention adapted for players of different heights or having different playing styles. Shorter or taller performers may require custom lengths or heights. In a preferred embodiment, the overall length of the leg portion ranges at least between about 25 inches to about 34 inches. In another preferred embodiment, the overall length of the leg portion ranges at least between about 34 inches and about 43 inches. In another preferred embodiment, the overall length of the leg portion ranges at least between about 43 inches and about 48 inches long.

In preferred embodiments, the length of the leg portion 600 is adjustable. A telescoping leg portion 600 or sliding shafts with a twist locking mechanism for selecting any desired length can be utilized.

Materials which can be particularly useful in the elongated leg portion, the rigid portion and/or the flexible, tapered section include, but are not limited to, wood, reed or natural fiber materials, synthetic fiber, carbon, metal, tubular, solid, laminate, resin, composite or other appropriate natural or synthetic material.

Figure 7:
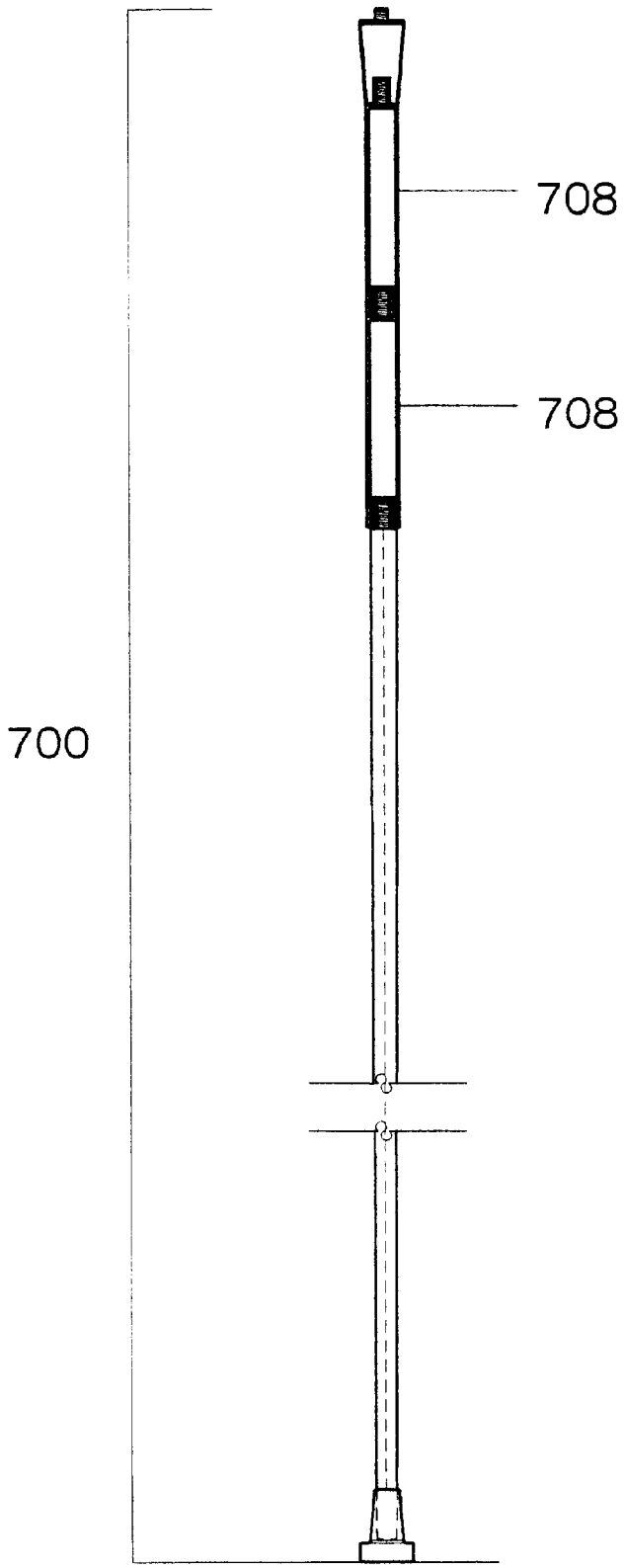
FIG. 7 is a representative schematic view of an alternate preferred embodiment of the rod portion 700 and its components of the guitar stand 100 of the present invention.

FIG. 7 is a representative schematic view of an alternate preferred embodiment of the rod portion 700 and its components of the guitar stand 100 of the present invention that includes a plurality of upper or proximal rigid shaft portions 708 to adjust the rod length. It will be understood that the placement or position of the rigid portions 708 and flexible and/or tapering shaft portions can be altered or adapted for various applications, and all these adaptations and variations shall be considered to lie within the scope of the present invention.

Figure 8A:
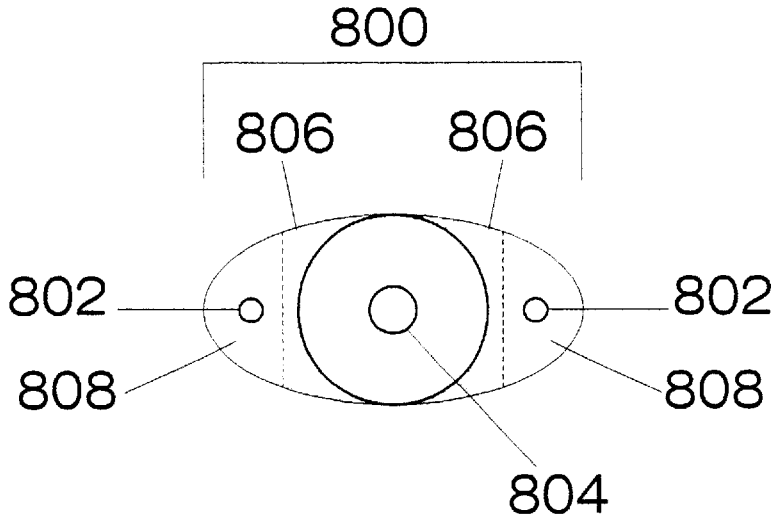
FIG. 8A is a representative schematic plan view of the mounting plate 800 of the preferred embodiment of the present invention.
Figure 8B:
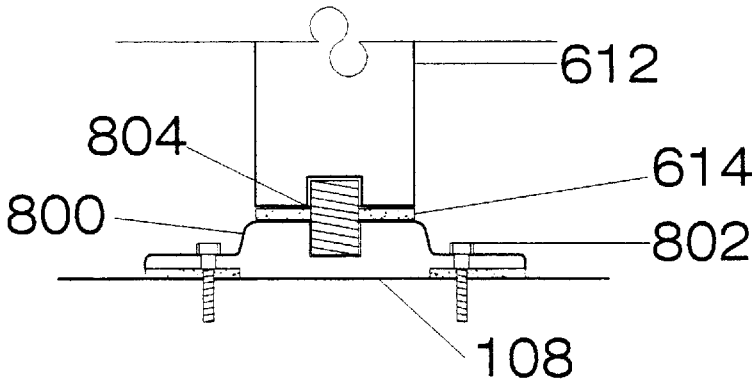
FIG. 8B is a representative schematic section view of the mounting plate 800 of the preferred embodiment of the present invention.

FIG. 8A is a representative schematic plan view of the mounting plate 800 of the preferred embodiment of the present invention. FIG. 8B is a representative schematic section view of the mounting plate 800 of the preferred embodiment of the present invention. It consists of a metal plate 800 that is attached to underside of the instrument body with screws 802. The plate 800 can be hinged with hinges 806 laterally positioned with side flange 808. In a preferred embodiment, the mounting plate 800 has an opening or female-threaded portion 804 to accept a screw-in collar portion 612 from the proximal rigid portion 610 of the leg portion 600 (as also shown in FIG. 6).

Figure 8C:
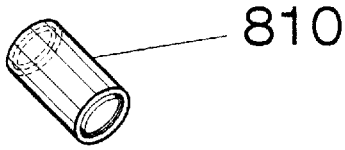
FIG. 8C is a representative schematic detail view of a preferred embodiment of the barrel portion 810 of the present invention to be recessed into an instrument body.

FIG. 8C is a representative schematic detail view of a preferred embodiment of the barrel portion 810 of the present invention to be recessed into an instrument body (not shown). The barrel 810 can be fluted and inset into the instrument body (not shown), and internally threaded surfaces allow the barrel 810 to accept a screw-threaded shaft portion of the instrument stand 100. It will be understood that there will become immediately apparent to those skilled in the art numerous ways and means for coupling the flexible leg portion or other portion of the instrument stand 100 to the underside or any other portion of the instrument body in an operative manner, including any of various female and corresponding male-threaded nipples, collars or adapters, bayonet-mounting, twist-lock or snap-lock type coupling systems.

Unless defined otherwise, all technical and scientific terms used herein have the same meaning as commonly understood by one of ordinary skill in the art to which the present invention belongs. Although any methods and materials similar or equivalent to those described can be used in the practice or testing of the present invention, the preferred methods and materials are now described. All publications and patent documents referenced in the present invention are incorporated herein by reference.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, with the limits only of the true purview, spirit and scope of the invention.

I claim:

1. An instrument stand to help a player support and play a stringed musical instrument at playing height, the instrument stand comprising:

a singular, elongated leg portion made with resilient, flexible material, the leg portion having a proximal end and a distal end and a predetermined, operative length, the distal end adapted to be placed directly on the playing surface;

a mounting portion for securing the leg to the instrument at the proximal end, wherein the instrument stand provides resilient and resistive support for the instrument.

2. The instrument stand of claim 1 in which the singular, elongated leg portion is tapered.

3. The instrument stand of claim 1 in which the singular, elongated leg portion is further comprised of at least one flexible section and one rigid section.

4. The instrument stand of claim 1 in which the singular, elongated leg portion further comprises an internal tensioning rod for selectively adjusting the flexibility of the elongated leg portion.

5. The instrument stand of claim 1 further comprising a foot coupled to the distal end of the elongated leg portion for providing enhanced frictional grip between the instrument stand and the surface upon which the instrument is being played, the foot formed out one or more materials in the group of materials comprising rubber, high coefficient of friction material, plastic.

6. The instrument stand of claim 1 in which the singular, elongated leg portion is adjustable in length.

7. The instrument stand of claim 1 in which the singular, elongated leg portion is formed utilizing any of the materials contained in the group consisting of wood, bamboo, reed or natural fibers material, synthetic fiber, carbon, metal, tubular, solid, laminate, resin, composite or other appropriate natural or synthetic material.

8. The instrument stand of claim 1 in which the mounting portion comprises a mounting plate for mounting onto the body of the instrument to be supported.

9. The instrument stand of claim 1 in which the mounting portion comprises a clip portion.

10. The instrument stand of claim 9 in which the clip portion is padded.

11. The instrument stand of claim 1 in which the mounting portion comprises a clamp portion.

12. The instrument stand of claim 11 in which the clamp portion is padded.

13. The instrument stand of claim 1 in which the mounting portion comprises a base support portion.

14. The instrument stand of claim 13 in which the base support portion is padded.

15. A method of playing a stringed musical instrument comprising the following steps:

A. Coupling an instrument stand with a single, elongated leg portion made of resilient, flexible material to the instrument; and B. Supporting the instrument with the resilient instrument said extending directly from the instrument to the ground.

16. The method of claim 15 in which during step B, the instrument stand is maintained in an essentially vertical position.

17. The method of claim 15 in which during step B, the instrument is supported with the stand oriented at an angle.

18. The method of claim 15 in which during step B, the instrument is supported with the stand in a flexed position.

19. A stand for a guitar or other player-held, stringed musical instrument comprising:

an singular elongated leg portion comprising a resilient, flexible material, the leg portion extending directly from the musical instrument to the floor, and a mounting portion for securing the leg portion to the instrument, wherein the stand provides resilient and resistive support while playing the musical instrument.

* * * * *